US006044978A

United States Patent [19]

Newell et al.

[11] Patent Number: 6,044,978

[45] Date of Patent: Apr. 4, 2000

[54] PROCESS FOR RECOVERY OF COPPER, NICKEL AND PLATINUM GROUP METAL BEARING MINERALS

[75] Inventors: Andrew James Haigh Newell, Chatswood; David William Clark, Gladesville, both of Australia; Henry Nhlanhla Gumede, Germiston, South Africa

[73] Assignee: BOC Gases Australia Limited, New South Wales, Australia

[21] Appl. No.: 09/114,655

[22] Filed: Jul. 13, 1998

[30] Foreign Application Priority Data

Jul. 14, 1997 [AU] Australia ..... P007882

[51] Int. Cl.[7] ..... B03D 1/02; B03B 1/04; B03B 1/00

[52] U.S. Cl. ..... 209/164; 209/166; 209/167; 241/24.13; 241/24.25

[58] Field of Search ..... 209/164, 166, 209/167; 241/24.13, 24.25

[56] References Cited

U.S. PATENT DOCUMENTS

| | | |
|---|---|---|
| 1,488,745 | 4/1924 | Ellis . |
| 1,505,323 | 8/1924 | Eberenz . |
| 2,048,370 | 7/1936 | Brinker . |
| 2,154,092 | 4/1939 | Hunt . |
| 4,735,783 | 4/1988 | Bulatovic . |

FOREIGN PATENT DOCUMENTS

| | | |
|---|---|---|
| 499430 | 12/1976 | Australia . |
| 39027/95 | 5/1996 | Australia . |
| 2163688 | 5/1996 | Canada . |
| 60-220155 | 10/1985 | Japan . |
| WO 96/01150 | 1/1996 | WIPO . |

OTHER PUBLICATIONS

Xu, et al., "Sphalerite Reverse Flotation Using Nitrogen," Proc. Electrochem Soc., vol. 92–17, Proc. Int., Symp. Electrochem. Miner. Met. Process. III, 3rd, pp. 170–190 (1992).

Kongolo et al., "Improving the efficiency of sulphidization of oxidized copper ores by column and inert gas flotation," Proceedings of COPPER 95–COBRE 95 International Conference, vol. II, The Metallurgical Society of CIM, pp. 183–196, 1995.

J.H. Ahn and J.E. Gebhardt. "Effect of Grinding Media–Chalcopyrite Interaction on the Self–Induced Flotation of Chalcopyrite", International Journal of Mineral Processing, 1991, pp. 243–262, vol. 33. Elsevier Science Publishers B.V., Amsterdam.

*Primary Examiner*—Thomas M. Lithgow

[57] ABSTRACT

The present invention provides a process for the recovery of base metal sulfides including chalcocite, chalcopyrite, pentlandite and platinum group metal bearing mineral ores. The process involves passing a slurry of the ore through a reagent conditioning stage wherein suitable activators, collectors, frothers and/or depressants are added, further conditioning the slurry with a non-oxidizing gas in a quantity conducive to the separation of the sulfide minerals from the remainder of the ore and subsequently subjecting the slurry to a final flotation treatment with a flotation gas having a higher oxygen content than the non-oxidizing gas. The non-oxidizing gas conditioning can be carried out prior to or after the reagent conditioning stage.

12 Claims, 2 Drawing Sheets

PROCESS FOR RECOVERY OF COPPER, NICKEL AND PLATINUM GROUP METAL BEARING MINERALS

The present invention relates to froth flotation separation of minerals and in particular froth flotation of chalcopyrite, pentlandite, chalcocite, and platinum group metal-bearing minerals.

BACKGROUND OF THE INVENTION

Platinum group metals (PGM) occur in mainly two forms, as discrete minerals and in solid solution in base-metal sulfides. PGMs and PGM minerals are often associated with nickel and copper ores. However, this is not always the case. In South Africa, for example, PGMs are recovered from both Merensky and UG-2 ores.

The predominant base-metal sulfides in Merensky ore are chalcopyrite, pentlandite, pyrrhotite and pyrite. Pentlandite, pyrrhotite and pyrite contain various amounts of platinum, palladium and rhodium. UG-2 ore contains a high chromite content (60–90%) along with 5–25% of gangue silicates, orthopyroxene and 5–15% plagioclase. Trace amounts of base-metal sulfides may also be present, mainly interstitially to the chromite grains. The sulfides are mainly pentlandite, pyrrhotite, chalcopyrite, cobalt-pentlandite and millerite. The PGMs are usually associated with the base metal sulfides and are normally included in or attached to the sulfide grains.

The platinum group metals, which includes platinum, palladium, rhodium, osmium, iridium and, are recovered by traditional flotation methods, i.e. crushing, milling and flotation. Many producers, for example in South Africa, re-grind and float the flotation tail in a so-called MF/MF circuit, i.e. mill/float, mill/float.

Of course, the primary objective of these conventional flotation processes is to increase the recovery of PGMs. Unfortunately, however, the conventional processes have several problems. The first of these is the chromite content in the final flotation concentrate. As chromite has a relatively high density and is brittle in nature, it is inevitably overground in a milling circuit. This results in fine chromite being entrained in the final concentrate with serious implications in the downstream smelting process when the levels of $Cr_2O_3$ are excessive. Indeed, the maximum permissible chromite content in the final concentrate is preferably 3–4% depending upon the smelter.

Conventional flotation processes also have difficulty in separating PGMs while maintaining an acceptable grade. The flotation rates/kinetics of sulfide minerals are slow. Therefore, in order to achieve an acceptable grade/recovery, conventional flotation circuits have extensive stages of cleaning and re-cleaning.

The order of sulfide mineral bulk flotation response in descending order is chalcopyrite, pyrite, pentlandite and pyrrhotite.

Lastly, the effect of talc can vary from mild to severe depending upon the degree of alteration of the ore. Moderate quantities of talc may be handled by the addition of a depressant such as CMC. However, large quantities of talc create serious difficulty.

It is an object of the present invention to overcome at least some of the disadvantages of the prior art or provide a commercial alternative thereto.

SUMMARY OF THE INVENTION

The present invention provides a process for the recovery of valuable sulfide mineral ores wherein a slurry of said ore which has been conditioned with conventional activators, collectors, frothers and/or depressants is further conditioned with a non-oxidizing gas in a quantity conducive to improving separation of the sulfide minerals from the remainder of said ore, and subsequently subjecting said slurry to a final flotation treatment with a gas having a higher oxygen content than said non-oxidizing gas. The present process is suitable for recovery of various base metal sulfide minerals. It is particularly suitable for recovery of chalcopyrite, chalcocite, pentlandite, pyrrhotite and pyrite, and PGM-bearing sulfide minerals.

DETAILED DESCRIPTION OF THE PREFERRED EMBODIMENTS

Figure 1:
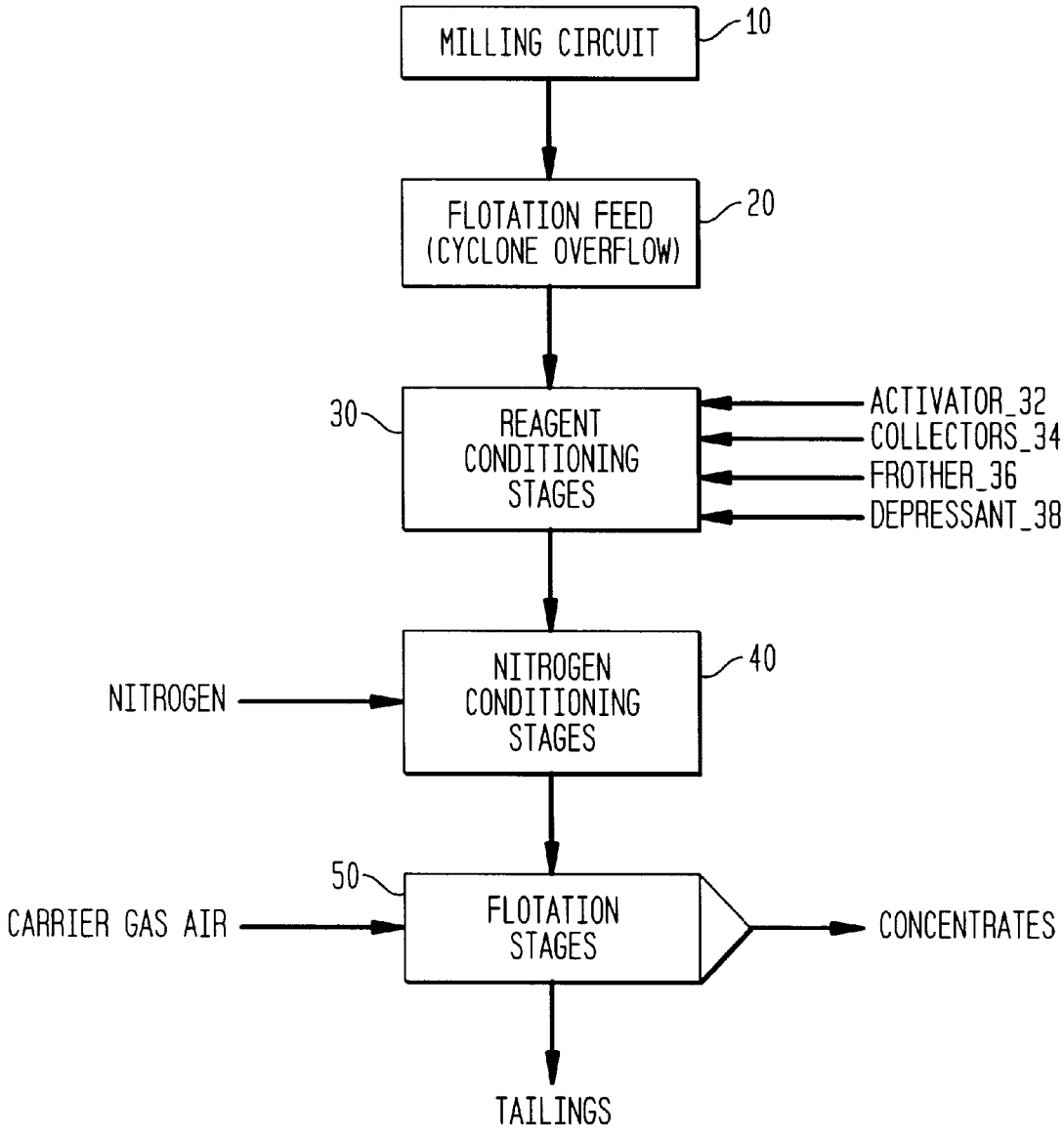
FIG. 1 is a simplified flow diagram of a process for the treatment of PGM mineral bearing ores according to a first embodiment of the present invention.

In accordance with the present invention, it has been found that when a slurry of base metal sulfide minerals which has been conditioned with conventional agents is further conditioned with a non-oxidizing gas an subsequently subjected to a final flotation with a gas having a higher oxygen content than the non-oxidizing gas substantial improvement in the recovery of the valuable minerals is achieved. The process of the invention is particularly suitable for recovery of chalcopyrite, chalcocite, pentlandite, pyrrhotite and pyrite, and PGM-bearing sulfide minerals.

The non-oxidizing gas is conveniently to be selected from the group consisting of inert gases, carbon dioxide, methane, ethane, propane and sulfur dioxide, the latter possessing an additional advantage in that it may itself be utilized as a sulfoxy radical-containing reagent. Of the inert gases, nitrogen is most preferred for cost reasons, but other art-recognized inert gases, such as argon, can be utilized as well.

The gas utilized in the final flotation step is preferably air, but may be any suitable gas with an oxygen content greater than the non-oxidizing gas, e.g. nitrogen or another inert gas with an increased oxygen content, or oxygen-depleted air.

While it is preferred that the conditioning of the mineral slurry with non-oxidizing gas in accordance with the present invention be carried out prior to the reagent conditioning stage, it may take place subsequent thereto as well. By "reagent conditioning stage" is meant treatment of the slurry with conventional agents including activators, collectors, frothers and depressants. Such agents and their use are well known to those skilled in the art, hence they will not be further detailed herein. Regardless of whether the conditioning with the non-oxidizing gas takes place before or after the reagent conditioning stage, it precedes the final flotation treatment.

The conditioning of the slurry with non-oxidizing gas may be conducted in a range of equipment including mechanically agitated conditioner vessel(s), gas agitated vessel(s) (Pachua), flotation cell(s), modified flotation cell(s) and slurry pipe line, hydrocyclones or modified versions thereof. The conditioning with the non-oxidizing gas in accordance with the present process may vary upon several factors including the ore type and may require as much as several hours. Typically, however, conditioning with the non-oxidizing gas is carried out for a period between 1 and 30 minutes, preferably between 2 and 10 minutes prior to flotation. The quantity of non-oxidizing gas added to the slurry depends on a number of factors, but is preferably between about 0.1 and 10 cubic meters per ton of mineral-bearing ore. It is desired to achieve a very low oxygen content in the slurry, preferably below 1.0 ppm, most preferably below 0.1 ppm.

In addition to conditioning with the non-oxidizing gas prior to the final flotation step, it is within the scope of the present invention to carried out an initial flotation using the non-oxidizing gas. In another embodiment of the invention, the non-oxidizing gas conditioning or flotation step may be included in a milling circuit such that the slurry leaves the milling circuit, is conditioned and, if desired, floated using a non-oxidizing gas and the resultant tailings returned to the milling circuit and subsequently to the final treatment.

In a preferred embodiment of the present invention, the flotation maybe conducted over the several stages to remove a PGM bearing chalcopyrite followed by a PGM-bearing pentlandite followed by PGM bearing a pyrrhotite and pyrite. In such a circuit, the slurry can be conditioned with the non-oxidizing gas prior to its entry into a series of flotation cells. The first group of cells may use the non-oxidizing gas a flotation gas with the remainder using the gas containing a higher oxygen content, e.g. air, as the flotation gas. Such an arrangement may be provided in rougher/scavenger circuit or in the cleaner circuits of a mineral recovery plant.

The applicants have found that the injection of a non-oxidizing gas into the slurry not only increases recovery of PGMs and PGM minerals, but also improves recovery of the base metals e.g. nickel, copper, which are intimately associated with the PGMs. It has also surprisingly been found that the use of such a discrete conditioning period in which the slurry is intimately contacted with a non-oxidizing gas improves the recovery of both the base metal sulfides, e.g. chalcopyrite, pentlandite, pyrrhotite and pyrite along with the PGMs and PGM minerals associated therewith.

The improved process not only improves recovery but also simplifies the equipment necessary for recovery of PGMs. As mentioned above, existing technology uses multiple rougher/cleaner flotation stages or the so called MFMF circuit (mill/float, mill/float) to achieve an acceptable concentrate. Use of the present invention avoids or at least reduces the need for such complex flotation circuitry.

Turning to the drawings, in the first embodiment shown in FIG. 1, the PGM-bearing ore is milled, normally in a liquid, in the milling circuit 10. A suitable liquid diluent, e.g. water, is then added to this milled material and the resultant slurry passed through a separation means 20, e.g. a cyclone bank. The overflow from the separation means 20, i.e. a slurry of the required size, is then fed to the reagent conditioning stage 30. In this stage one or more of a suitable activator 32, e.g. $CuSO_4$, a collector 34, preferably a xanthate, e.g. SIBX, a frother 36, such as MIBC, and a suitable depressant 38, such as dextrin or other organic colloids, may be added either separately or simultaneously.

The slurry is then transferred to a non-oxidizing gas condition stage 40 where it is conditioned with, e.g. nitrogen, for a suitable period as discussed above. The nitrogen conditioned slurry is then transferred to the flotation stages 50 where flotation is carried out with air as the carrier gas in a number of stages. In a preferred embodiment, the flotation stages may be arranged to selectively remove various base metal sulfide minerals which are intimately associated with the PGM mineral. For example, the flotation stages may be arranged to remove in order PGM bearing chalcopyrite, followed by PGM bearing pentlandite followed by PGM bearing pyrrhotite and pyrite.

The applicants have found that dosing the slurry with a non-oxidizing gas such as nitrogen increases the recovery of both the base metal sulfide and the associated PGM minerals. In the case of Merensky ores, for example, there appears to be a direct correlation between nickel, copper recovery and PGM values.

Figure 2:
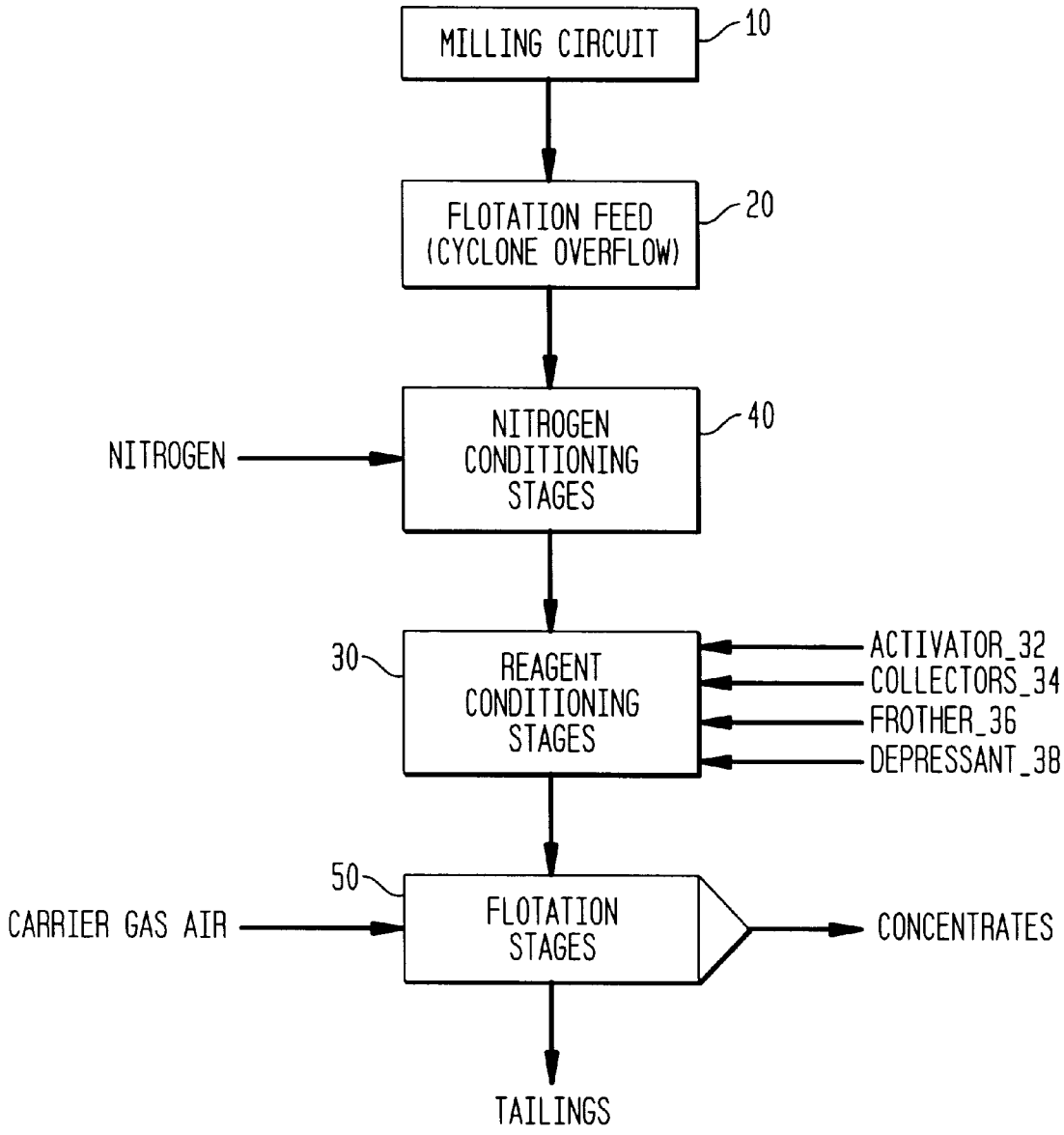
FIG. 2 is a simplified flow diagram of a process for the treatment of PGM mineral bearing ores according to a second embodiment of the present invention.

FIG. 2 shows an alternative embodiment of the present invention. In this embodiment, the non-oxidizing gas conditioning stage 40, which once again uses nitrogen, is placed prior to the reagent conditioning stage 30. Once again, one or more of the activator 32, collector 34, frother 36 and depressant 38 may be added at the reagent conditioning stage 30.

The following examples serve to further clarify the present invention.

Two tests were conducted in which 1 kg charges of crushed ore containing disseminated nickel and copper sulfides with associated PGM minerals assaying 0.6% nickel and 0.2% copper were slurried in water to obtain pulp density 60 wt % solids and milled in a stainless steel rod mill to achieve P78 of approximately 75 microns.

The milled slurry was then transferred to a 2.5 liter Denver flotation cell and diluted with water to achieve a pulp density 35 wt % solids. The agitator speed was set at 1200 rpm and maintained constant throughout the tests. The appropriate quantity of sulfide mineral collectors were added and the slurry was conditioned for 13 minutes. In the subject test sample (Example 1) $N_2$ gas at 1 liter per minute was added by injection into the slurry for the full 13 minutes of the collector conditioning. In the comparative test (Example 2) no $N_2$ gas was added to the control sample. At the completion of collector conditioning, an appropriate quantity of talcose depressant was added together with a quantity of frother. The slurry was conditioned for a further 2 minutes prior to flotation.

Flotation with air was commenced and six rougher concentrates were produced after 1, 2, 4, 8, 12 and 16 minutes respectively of flotation. Additional talcose depressant was added after production of the $1^{st}$ and $3^{rd}$ rougher concentrates respectively.

The flotation products were assayed for nickel and copper content. The recovery of PGM minerals is known to be proportional to the flotation recovery of nickel and copper.

EXAMPLE 1

Metallurgical results, i.e. flotation performance, of the test following the procedure outlined above with $N_2$ gas being added at 1 liter per minute for 13 minutes during collector conditioning. During this time the measured dissolved content of the slurry was close to zero:

| | Assay | | Distribution | |
|---|---|---|---|---|
| Product | Ni | Cu | Ni | Cu |
| Conc 1 | 7.76 | 15.5 | 8.3 | 49.7 |
| Conc 1 + 2 | 11.6 | 8.37 | 36.3 | 78.2 |
| Conc 1 + 2 + 3 | 10.48 | 4.78 | 64.1 | 87.3 |

-continued

| Product | Assay Ni | Assay Cu | Distribution Ni | Distribution Cu |
|---|---|---|---|---|
| Conc 1 + 2 + 3 + 4 | 9.12 | 4.02 | 68.0 | 89.5 |
| Conc 1 + 2 + 3 + 4 + 5 | 7.82 | 3.39 | 69.9 | 90.6 |
| Conc 1 + 2 + 3 + 4 + 5 + 6 | 6.67 | 2.88 | 71.0 | 91.3 |

EXAMPLE 2

Metallurgical results of the comparative example with no inert gas conditioning:

| Product | Assay Ni | Assay Cu | Distribution Ni | Distribution Cu |
|---|---|---|---|---|
| Conc 1 | 7.83 | 9.59 | 18.4 | 73.1 |
| Conc 1 + 2 | 8.61 | 7.08 | 30.1 | 80.5 |
| Conc 1 + 2 + 3 | 7.82 | 4.66 | 43.2 | 83.7 |
| Conc 1 + 2 + 3 + 4 | 6.90 | 3.79 | 47.9 | 85.5 |
| Conc 1 + 2 + 3 + 4 + 5 | 5.71 | 2.96 | 51.5 | 86.6 |
| Conc 1 + 2 + 3 + 4 + 5 + 6 | 4.73 | 2.38 | 53.5 | 87.4 |

In both examples, the flotation gas used was air. The test data clearly indicates that conditioning with nitrogen gas has significantly increased the flotation recoveries of nickel and copper and the concentrate of the nickel and copper content.

The beneficial effect found from conditioning with nitrogen is quite surprising particularly as the example uses air as the flotation gas. Such an arrangement is much simpler to apply in practice than total nitrogen flotation or milling in the complete absence of oxygen. The benefit of nitrogen conditioning was less pronounced on milled ore slurries already deficient in dissolved oxygen. In the examples given, the milled slurry after transfer to the flotation cell had a dissolved oxygen content of approximately 60% of air saturation. In the test involving nitrogen conditioning, this was reduced to close to 0%.

The present inventive process provides improved base metal sulfide and PGM recovery. It also improves the base metal grades of concentrate which, as will be clear to persons skilled in the art, has a significant impact on smelting of the resultant concentrate. It will also be clear to persons skilled in the art that the present invention provides an opportunity to simplify existing technology for the recovery of the PGMs.

It will be understood that the present invention maybe embodied in forms other than that disclosed in the specification without departing from the spirit or scope of the invention. Unless the context clearly requires otherwise, throughout the description and the claims, the words 'comprise', 'comprising', and the like are to be construed in an inclusive as opposed to an exclusive or exhaustive sense; that is to say, in the sense of "including, but not limited to".

We claim:

1. A process for the recovery of valuable sulfide copper, nickel and platinum group metal (PGM) mineral ores consisting of: providing a slurry of such ores; conditioning the slurry with one or more of suitable reagents including activators, collectors, frothers and depressants; subjecting the slurry to additional conditioning with a non-oxidizing gas comprising one or more members selected from the group consisting of nitrogen, argon, carbon dioxide, methane, propane and ethane in a quantity conducive to achieve a dissolved oxygen level below 1.0 ppm thereby enhancing the separation of the sulfide minerals from the remainder of said ores, and subsequent to said conditioning, subjecting the slurry to a final flotation treatment with a gas having a higher oxygen content than said non-oxidizing gas to thereby recover said minerals.

2. A process in accordance with claim 1, wherein said conditioning with the non-oxidizing gas is carried out as in initial flotation treatment, prior to said final flotation treatment.

3. A process in accordance with claim 1, wherein the ore contains base metal sulfides selected from the group consisting of chalcocite, chalcopyrite, pentlandite, pyrrhotite and pyrite, said slurry being conditioned with a non-oxidizing gas in a quantity conducive to enhancing separation of one or more of said base metal sulfides from said ore.

4. A process in accordance with claim 3, wherein the flotation treatment is carried out over several stages to selectively recover PGM-bearing chalcopyrite, followed by PGM-bearing pentandite, followed by PGM-bearing pyrrhotite and pyrite.

5. A process in accordance with claim 1, wherein the final flotation treatment uses air as the flotation gas.

6. A process in accordance with claim 1, wherein the non-oxidizing gas is added to the slurry prior to conditioning with said reagents.

7. A process in accordance with claim 1, wherein the non-oxidizing gas is added to the slurry after conditioning with said reagents, but prior to the final flotation treatment.

8. A process in accordance with claim 1, wherein the slurry is conditioned with the non-oxidizing gas for between 1 and 30 minutes.

9. A process in accordance with claim 8, wherein the slurry is conditioned with the non-oxidizing gas for between 2 and 10 minutes.

10. A process in accordance with claim 1, wherein the slurry is conditioned with the non-oxidizing gas to achieve a dissolved oxygen level below 0.1 ppm.

11. A process in accordance with claim 1, wherein after conditioning with the non-oxidizing gas, the slurry is transferred to a series of flotation cells, a first group of the cells using the non-oxidizing gas as a flotation gas and the remainder of the cells being said final flotation treatment using a gas having a higher oxygen content than said inert/non-oxidizing gas as the flotation gas.

12. A process in accordance with claim 11, wherein the conditioning and flotation with the non-oxidizing gas is conducted in a milling circuit whereby the slurry leaves the milling circuit and is conditioned and floated using the non-oxidizing gas as the flotation gas, the tailings from this flotation step being returned to the mill for further grinding and the subsequent final flotation treatment.

* * * * *